US006652377B1

(12) United States Patent
Moody

(10) Patent No.: US 6,652,377 B1
(45) **Date of Patent: *Nov. 25, 2003**

(54) ELECTRONIC VIDEO SLOT AND POKER GAMES

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 549 days.

This patent is subject to a terminal disclaimer.

(21) Appl. No.: 09/633,479

(22) Filed: Aug. 7, 2000

Related U.S. Application Data

(63) Continuation-in-part of application No. 09/395,292, filed on Sep. 13, 1999, now Pat. No. 6,120,378, which is a continuation-in-part of application No. 09/175,226, filed on Oct. 20, 1998, now Pat. No. 6,098,985, and a continuation-in-part of application No. 09/083,531, filed on May 22, 1998, now Pat. No. 6,007,066, and a continuation-in-part of application No. 09/040,143, filed on Mar. 17, 1998, now Pat. No. 5,976,016, and a continuation-in-part of application No. 08/900,965, filed on Jul. 25, 1997, now Pat. No. 5,823,873, and a continuation-in-part of application No. 08/755,174, filed on Nov. 25, 1996, now Pat. No. 5,732,950, and a continuation-in-part of application No. 08/495,952, filed on Jun. 28, 1995, now Pat. No. 5,531,448.

(60) Provisional application No. 60/019,879, filed on Jun. 17, 1996.

(51) Int. Cl.[7] ..... A63F 13/00; G07F 17/34

(52) U.S. Cl. ..... 463/13; 463/20; 273/143 R

(58) Field of Search ..... 273/292, 274, 273/309, 143 R, 138.2; 463/13, 12, 20

(56) References Cited

U.S. PATENT DOCUMENTS 5,580,053 A * 12/1996 Crouch ..... 463/20
5,823,873 A * 10/1998 Moody ..... 463/13

* cited by examiner

*Primary Examiner*—Benjamin H. Layno
(74) *Attorney, Agent, or Firm*—John Edward Roethel

(57) ABSTRACT

A card game in which the player makes a wager to play one or more poker hands which are displayed as pay lines in a display that looks like a multi-line slot reel machine. Three adjoining horizontal rows, each having five card locations, are displayed to the player. The reels are spun a first time and one row of playing cards, such as the center row and representing a first hand, are displayed to the player. The player selects none, one or more of the face up cards from the first hand as cards to be held. The cards that are held are reused from the first row into all of the other rows. The reels that do not have held cards are then respun so that additional cards are displayed into the first row and all other rows so that each row is a five card hand. The poker hand ranking of each five card hand along each pay line which is being played by the player is determined. The player is then paid for any winning poker hands based on a pay table and the amount of the player's wager. The pay lines may comprise any suitable configuration of cards as long as there is only one card used from each card position regardless of which row the card is displayed in. Slot symbols may be used in place of the playing cards and the player is paid for winning slot symbol combinations instead of poker hand rankings.

38 Claims, 13 Drawing Sheets

ELECTRONIC VIDEO SLOT AND POKER GAMES

CROSS-REFERENCE TO RELATED APPLICATIONS

This application is a Continuation-in-Part of application Ser. No. 08/495,952, entitled "Poker-Style Card Game", filed Jun. 28, 1995, now U.S. Pat. No. 5,531,448; and is also based on and is a Continuation-in-Part of Provisional Application Ser. No. 60/019,879, entitled "Electronic Video Poker Games", filed Jun. 17, 1996; and is also a Continuation-in-Part of application Ser. No. 08/755,174, entitled "Electronic Video Poker Games", filed Nov. 25, 1996, now U.S. Pat. No. 5,732,950; and is also a Continuation-in-Part of application Ser. No. 08/900,965, entitled "Electronic Video Poker Games", filed Jul. 25, 1997, now U.S. Pat. No. 5,823,873; and is also a Continuation-in-Part of application Ser. No. 09/040,143, entitled "Multi-line Slot Machine Method, filed Mar. 17, 1998, now U.S. Pat. No. 5,976,016; and is also a Continuation-in-Part of application Ser. No. 09/083,531, entitled "Electronic Video Poker Games", filed May 22, 1998, now U.S. Pat. No. 6,007,066; and is also a Continuation-in-Part of application Ser. No. 09/175,226, entitled "Electronic Video Poker Games", filed Oct. 20, 1998, now U.S. Pat. No. 6,098,995; and is also a Continuation-in-Part of application Ser. No. 09/395,292, entitled "Multi-line Slot Machine Method", filed Sep. 13, 1999, now U.S. Pat. No. 6,120,378. The disclosure of each of these earlier patents and/or applications is incorporated herein by this reference, with each of these earlier applications being commonly owned with this application.

BACKGROUND OF THE INVENTION

This invention relates primarily to electronic video gaming machines that allow the player to play both poker games and slot reel games. In one or more versions, the invention relates to electronic video poker games that are based on poker hand rankings and allow the player to discard and replace unwanted cards with replacement cards. The present invention has many versions with the common thread being that whatever cards are held by the player from a first hand are duplicated or reused into other hands and these cards are held. Additional cards are dealt as replacement cards for those cards discarded from the first hand and to complete the other hands and the player is paid for winning poker hand combinations. In other versions, slot symbols are used in the place of the playing cards and the player selects the slot symbols to hold from the first row and the held slot symbols are duplicated or reused in the other slot rows. The reels are respun to complete the slot rows and the player is paid for winning slot combinations.

SUMMARY OF THE INVENTION

One version of the present invention is a method involving a card game in which the player makes a wager to play one or more poker hands which are displayed as pay lines in a display that looks like a multi-line slot reel machine. In one embodiment of the present invention, three adjoining horizontal rows, each having five card locations, are displayed to the player. The reels are spun a first time and one row of playing cards, such as the center row and representing a first hand, are displayed to the player. The player selects none, one or more of the face up cards from the first hand as cards to be held. The cards that are held are duplicated or reused from the first row into all of the other rows, such as the top row and bottom row which adjoin the center row. The reels that do not have held cards are then respun so that additional cards are displayed into the first row and all other rows so that each row is a five card hand. The poker hand ranking of each five card hand along each pay line which is being played by the player is determined. The player is then paid for any winning poker hands based on a pay table and the amount of the player's wager. The pay lines may comprise any suitable configuration of cards as long as there is only one card used from each card position regardless of which row the card is displayed in.

Another version of the present invention is a method in which slot symbols are used in place of the playing cards. The method of play is the same as the playing card version and the player is paid for winning slot symbol combinations instead of poker hand rankings. Again, the pay lines may comprise any suitable configuration of slot symbols as long as there is only one slot symbol used from each reel position regardless of which row the slot symbol is displayed in.

DETAILED DESCRIPTION OF THE PREFERRED EMBODIMENTS

Figure 1:
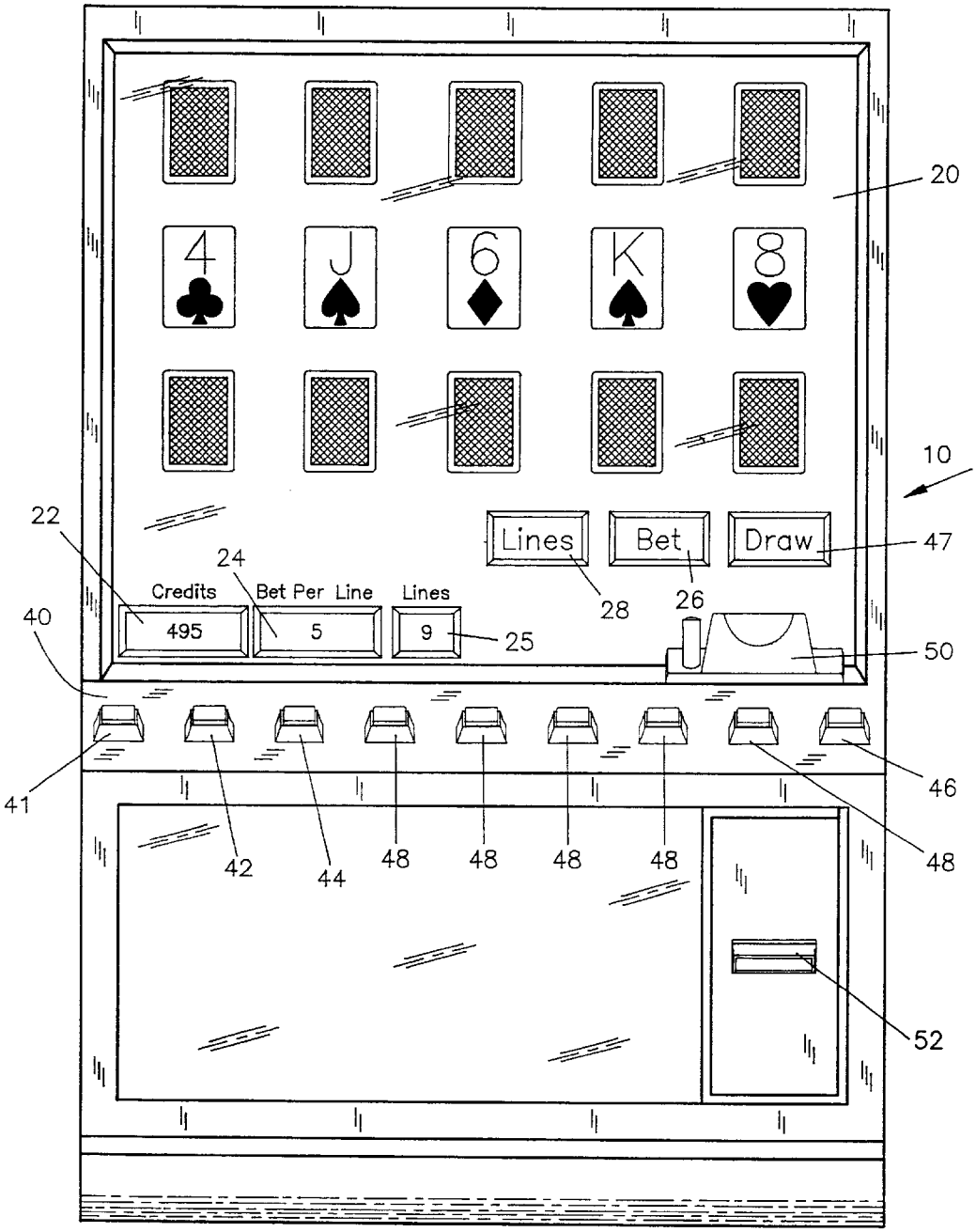
FIG. 1 shows a gaming machine that can be used to practice the method of the present invention.

The present invention includes a variety of electronic video poker and slot games. Each game uses a plurality of pay lines, with the number of possible pay lines exceeding the number of actual horizontal rows appearing in the video display.

In the method of play of TRIPLE PLAY POKER™ disclosed in U.S. Pat. No. 5,823,873 (the disclosure of which being incorporated herein), there are three pay lines, each comprising a single horizontal row of playing cards. In the method of play of the multi-line slot reels game disclosed in U.S. Pat. No. 5,976,016 (the disclosure of which being incorporated herein) each of the pay lines comprise a single horizontal row of slot symbols.

In a preferred embodiment of the present invention, the playing cards which form each poker hand or the slot symbols which form each slot symbol combination may come from more than one of the rows, and not just from a single horizontal row. This allows the number of pay lines to be increased beyond the number of horizontal rows displayed to the player.

One way to accomplish this desired result is to provide a matrix of card positions or a matrix of slot symbol positions and to then designate multiple pay lines which include both the straight pay lines formed by the horizontal rows and staggered pay lines that use one or more card positions of slot symbol positions from the matrix of card or slot symbol positions. The player then has the option to activate any one or more of a number of hands or pay lines by placing an appropriate wager on each hand or pay line that the player wishes to be active for that round of play of the game.

In one embodiment of the present invention, a three-by-five matrix of card or slot symbol positions is used. The "three" portion of the matrix represents the three horizontal rows and the "five" portion of the matrix are the five vertical columns of card or reel positions. In the preferred embodiment of the present invention, the card symbols or reel symbols will appear as representations of spinning reels when the game is activated for both the initial deal step and the draw step.

When using such a three-by-five matrix, any suitable configuration of hands or pay lines may be used. A preferred embodiment of the present invention would use the following nine pay lines.

Pay line #1 comprises the five cards of a center row:

| | | | | |
|---|---|---|---|---|
| | | | | |
| X | X | X | X | X |
| | | | | |

Pay line #2 comprises the five cards of a top row:

| | | | | |
|---|---|---|---|---|
| X | X | X | X | X |
| | | | | |
| | | | | |

Pay line #3 comprises the five cards of a bottom row:

| | | | | |
|---|---|---|---|---|
| | | | | |
| | | | | |
| X | X | X | X | X |

Pay line #4 comprises a "V"-shaped pay line containing cards from each of the rows:

| | | | | |
|---|---|---|---|---|
| X | | | | X |
| | X | | X | |
| | | X | | |

Pay line #5 comprises an inverted "V"-shaped pay line containing cards from each of the rows:

| | | | | |
|---|---|---|---|---|
| | | X | | |
| | X | | X | |
| X | | | | X |

Pay line #6 comprises two cards from the top row, a single card from the middle row, and two cards from the bottom row:

| | | | | |
|---|---|---|---|---|
| X | X | | | |
| | | X | | |
| | | | X | X |

Pay line #7 comprises two cards from the bottom row, a single card from the middle row, and two cards from the top row:

| | | | | |
|---|---|---|---|---|
| | | | X | X |
| | | X | | |
| X | X | | | |

Pay line #8 comprises three cards from the middle row, and a single card from each of the top row and bottom row:

| | | | | |
|---|---|---|---|---|
| | X | | | |
| X | | X | | X |
| | | | X | |

Pay line #9 comprises three cards from the middle row, and a single card from each of the top row and bottom row:

| | | | | |
|---|---|---|---|---|
| | | | X | |
| X | | X | | X |
| | X | | | |

These nine pay line configurations are merely representative of a myriad of pay line configurations which can be used. The total number of pay lines which may be used may be more or less than nine.

In one arrangement, wagers by the player activates the pay lines in sequential order starting with pay line #1 through pay line #9, with the player being required to place nine wagers in order to play all nine pay lines. In another arrangement, a player may be permitted to place one wager to play a group of pay lines. For example, a player may be permitted to place a single wager to play the first three pay lines, another wager for pay lines #4–#6, and yet another wager for pay lines #7–#9. In yet another arrangement, the player can simply select how many credits the player wishes to play on which of the pay lines up to maximum number of pay lines and credits allowed by the configuration of the gaming machine. In a preferred embodiment, the maximum wager would be forty-five credits (five credits wagered on each of the nine pay lines).

FIG. 1 shows generally at 10 a gaming machine upon which the method of the present invention can be carried out. The gaming machine 10 includes a video screen display 20 on which are shown the playing cards that will be used during the play of the method of the present invention. The video screen display 20 also includes other information and data presented to the player to allow the player to understand the play of the game and to effect the operation of the method.

In the preferred embodiment of the present invention, the video screen display 20 also shows a credit meter 22 and a first display 24 of the number of credits bet per hand, with each hand being considered a "line". A second display 25 shows the number of "lines" (pay lines) upon which the player has made a wager. The video screen display also has touch screen locations to allow the player to DRAW 47 replacement cards, to make his BET 26 and to choose the number of LINES 28 upon which the player wishes to wager. Each of the card locations on the video screen display can also be touch screen locations so that the player may designate which cards he wishes to hold by merely touching the card location on the video screen display 20.

The gaming machine 10 also has a button panel 40 which includes typical buttons that the player may press to activate various actions during the play of the method of the present invention. A CASH OUT button 41 is provided to allow the player to collect any credits which the player has accrued on the credit meter 22. A BET MAX button 42 and a BET ONE button 44 are provided to allow the player to wager either the maximum amount of credits permitted by the gaming machine or to wager one credit at a time on the play of the game as desired by the player. A DRAW button 46 is provided to allow the player to effect the draw step of the method of play as desired should the player prefer to use the button panel 40 instead of the DRAW touch screen location 47 on the video screen display 20. A plurality of HOLD buttons 48 are also provided to allow the player to select which cards the player wishes to hold should the player prefer to use the button panel instead of the card touch screen locations on the video screen display 20. If desired, buttons may be added to the button panel 40 to allow the player to select the number of pay lines upon which the player wishes to wager and to select the amount to be wagered on each active pay line.

The gaming machine 10 also includes a coin head 50 to allow the player to insert coins or gaming tokens as wagers to allow play of the gaming machine 10. A bill acceptor slot 52 is also provided on the gaming machine 10. In order to accrue credits that may be used to play the gaming machine 10, the player inserts paper currency or other suitable script or gaming coupons into the bill acceptor slot 52 behind which, on the interior of the gaming machine 10, is mounted a bill acceptor which takes in and validates the currency. The monetary value of the inserted currency is then applied to the credit meter 22, the credits on which the player may use to play the gaming machine.

The gaming machine 10 is operated by conventional computer controls which are mounted on the interior of the gaming machine. Any other conventional and suitable equipment can be included in the gaming machine 10.

The gaming machine of the present invention can be used for electronic video poker games designed to be played by having a first poker hand representing a first pay line displayed to a player on the video screen 22. By manipulating the buttons on the gaming device or by using conventional touch screen technology, the player selects which cards he wishes to play, which are then duplicated or reused into the other pay lines, and which cards he wishes to discard. Replacement cards are then displayed for the discarded cards on the first pay line, additional cards are displayed into the other pay lines and the outcome of the play of the hand is determined.

Again, in one arrangement, each row is treated as a separate hand for payout purposes. Each row is evaluated for poker hand ranking and the player is paid based on the amount of his wager on each row depending on the poker hand ranking achieved for that row. A suitable pay table is provided as is conventional for electronic video poker games with the amount of the player's winnings being based on the poker hand ranking achieved and the amount wagered by the player on each hand.

In the preferred embodiment of this version of the present invention, the amount of the player's wager on each pay line would be the same. Alternatively, the player could be allowed to make wagers of different amounts on each pay line.

Thus, the player has effectively played one to nine pay lines, as selected by the player, at the same time. The player could win on all nine pay lines, could lose on all nine pay lines, could win on some of the pay lines and lose on the other pay lines.

As described in more detail by way of example below, some of the pay lines will contain playing cards from only one row of cards and others of the pay lines will contain cards from more than one of the rows.

In the preferred embodiment of this invention, the game is dealt using a single standard fifty-two card deck. In this embodiment, all of the cards used to play the game are dealt from a single standard fifty-two card deck of playing cards. The initial deal of the cards for the first row come from this single deck. After the player selects the cards from the first row of cards that will be duplicated or reused into the other rows, if any, the replacement cards for the first row and the additional cards needed for the second and third rows all come from this same fifty-two card deck depleted by the first five cards.

In another embodiment of the present invention, the game is dealt using three separate decks of cards—the initial deal of the cards for the first row and the replacement cards for the first row are dealt using a first standard fifty two card deck. After the player selects the cards from the first row of cards that will be duplicated or reused into the other rows, the additional cards for the second row are dealt using a second deck of forty-seven cards which comprises a standard fifty-two card deck having the player's five initial face up cards shown in the first row omitted therefrom and the additional cards for the third row are dealt using a third deck of forty-seven cards which comprises a standard fifty-two card deck having the player's five initial face up cards shown in the first row omitted therefrom. This is accomplished using the computer controls that operate the gaming machine with the software being written so that the second and third decks used to deal the additional cards for second and third rows, respectively, have removed therefrom the five cards initially dealt.

In either the single deck embodiment or the multiple deck embodiment, one or more cards may alternatively be designated as wild cards or one or more Jokers may be added to the deck or decks and designated as wild cards. This allows the methods of the present invention to be applied to any of the various wild card video poker games that are known in the art, such as Deuces Wild or Jokers Wild.

Special bonus payouts can be added if the player achieves, either on the deal or after the draw, three hands of the same rank at the same time. These bonus payouts could be fixed amounts or progressive payouts. For example, the player could win a progressive payout for achieving nine Full Houses at the same time. As another example when three decks are used, the player can receive a large fixed or progressive payout if the player achieves the same poker hand in each of the three rows: such as a Royal Flush in Spades in all three rows which would yield nine Royal Flushes if the player had wagered on all nine pay lines.

Figure 2:
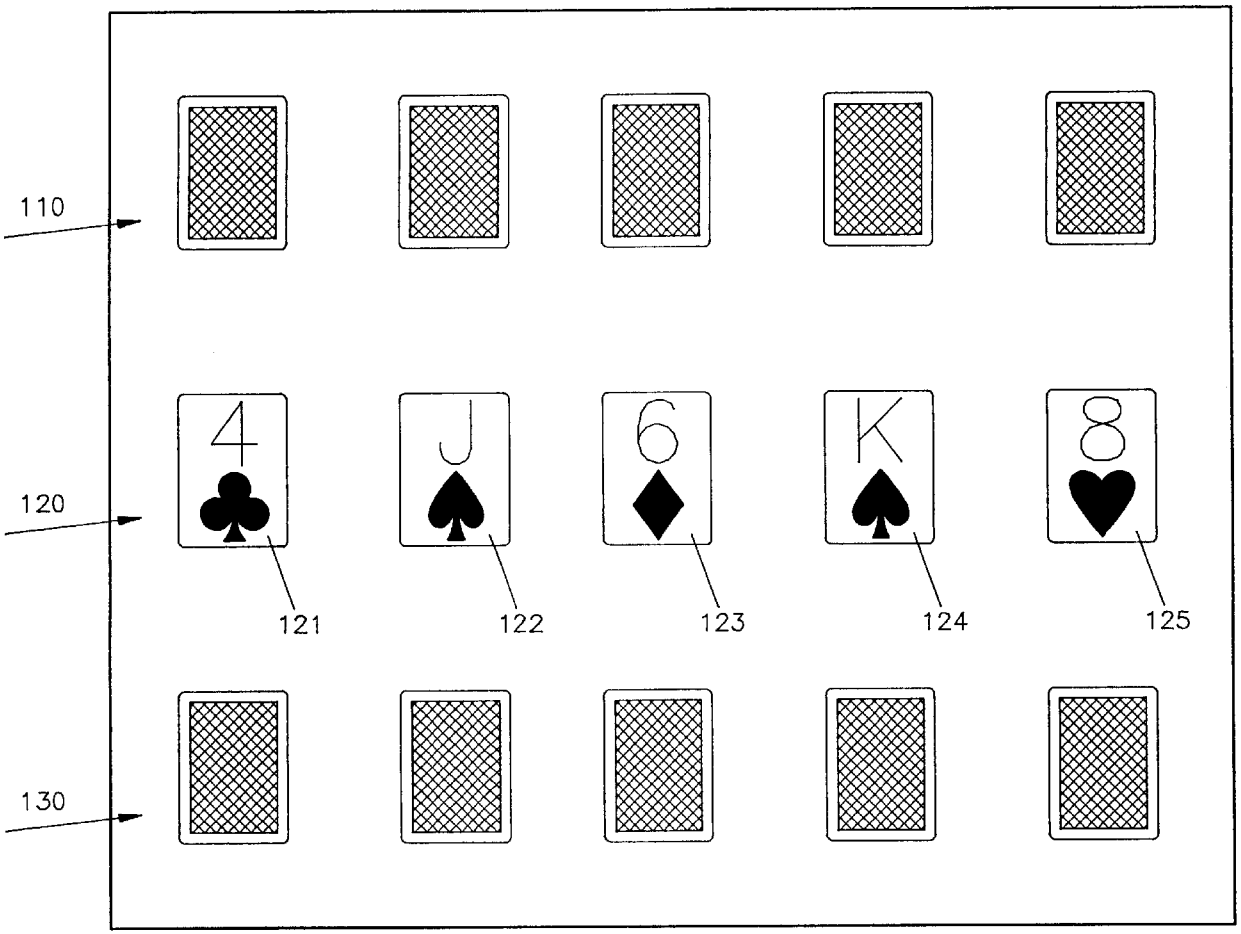
FIG. 2 shows the screen display for the poker game version of the present invention after the initial deal of the cards.

An example of play utilizing such an arrangement of these pay lines is shown in FIGS. 2–13. FIG. 2 shows the video display screen for an initial deal of five cards as displayed to the player, In the preferred embodiment of the present invention, the initial deal of five cards is displayed in the center row of the three-by-five matrix, although any row may be used to display the initial deal. The computer controls of the gaming machine electronically shuffle the deck of cards and randomly select five cards as the initial deal. The other two rows are shown with representations of face down cards.

The player initially starts the play of one round of the game by selecting which pay lines the player wishes to play and the amount of the wager on each pay lines. In the example shown in FIGS. 2–13, the player has chosen to wager on all nine pay lines and the amount wagered is five credits on each pay line for a total wager of forty-five credits. The player effects the line selection and the wager amount by using the BET location 26 and the LINES location 28 on the video screen display 22 or by using the appropriate buttons on the button panel 40. The indication of the number of pay lines is shown in the LINES meter 25 and the amount wagered on each line is shown in the BET PER LINE meter 24 on the video screen display 22. The CREDITS meter 22 will be decremented the amount of the player's total wager.

In the example shown in FIG. 2, the top row 110 has been dealt face down and the bottom row 130 has been dealt face-down. The initial deal of cards to the player in the center row 120 are the Four of Clubs 121, the Jack of Spades 122, the Six of Diamonds 123, the King of Spades 124 and the Eight of Hearts 125.

The player selects those cards in the center row 120 that he wishes to hold. The player effects this selection by pressing buttons or, using touch screen technology, by simply pressing the cards on the screen that the player wishes to hold. Each card that is held by the player from the center row 120 is duplicated or reused in the corresponding vertically aligned position in both the top row 110 and the bottom row 130. Therefore, three representations of each of the held cards are now displayed on the screen. The player may hold from zero to five cards from the center row 120.

Figure 3:
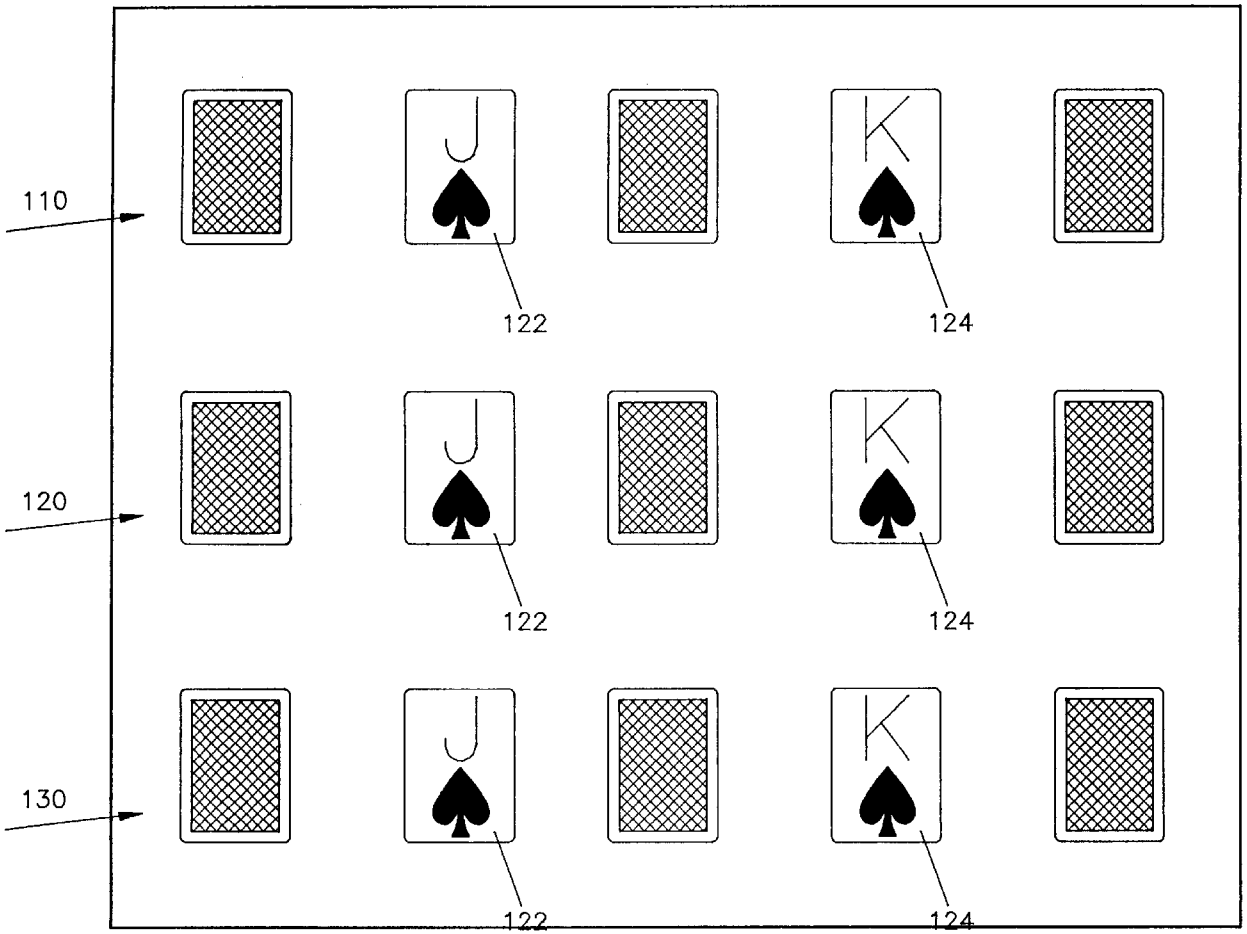
FIG. 3 shows the screen display for the poker game version of the present invention after the player selects the cards to be held.

FIG. 3 shows an example of the play of the hand when the player has held card 122 and card 124 from the center row 120. Card 122, the Jack of Spades, is duplicated or reused in the same aligned position in top row 110 and in bottom row 130. Likewise, card 124, the King of Spades, is also duplicated or reused in the same aligned positions in top row 110 and bottom row 130. All of the other card positions are shown as the back of playing cards indicating that cards will be dealt to these card positions when the draw step occurs.

After the player is satisfied with his selection of the held cards, the player presses the "DRAW" button and replacement cards are dealt for the discarded cards to complete each of the three rows.

Figure 4:
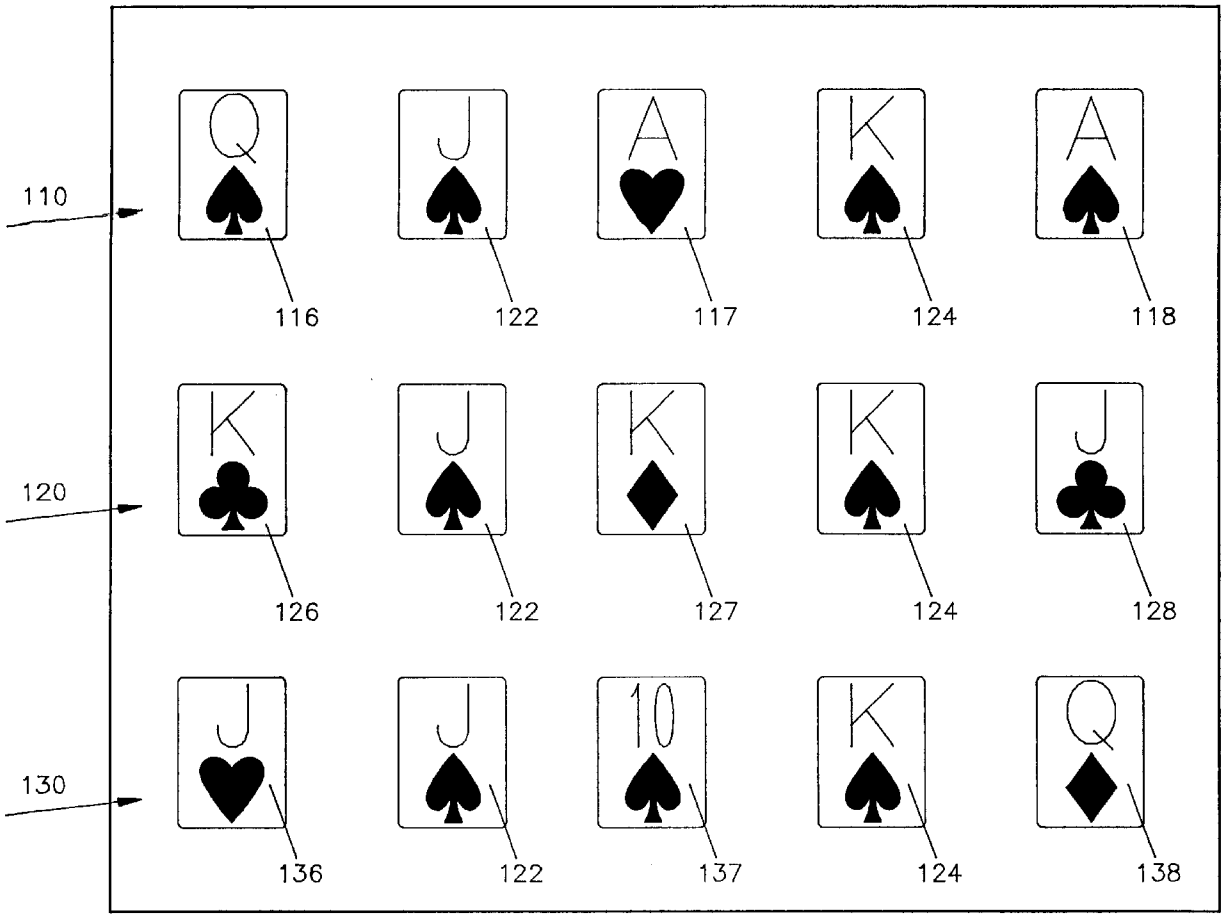
FIG. 4 shows the screen display for the poker game version of the present invention after the replacement and additional cards have been dealt.

As illustrated in FIG. 4, the card 126 in the center row 120 is dealt and is the King of Clubs, card 127 in the center row 120 is dealt and is the King of Diamonds and card 128 in the center row 120 is dealt and is the Jack of Clubs. Further, as shown in FIG. 4, cards are added to the top row 110 and bottom row 130 to complete five card hands in those rows. In this case, with regard to the top row 120, the added cards are card 116, the Queens of Spades; card 117, the Ace of Hearts and card 118, the Ace of Spades. With regard to the bottom row 130, the added cards are card 136, the Jack of Hearts; card 137, the Ten of Spades and card 138, the Queen of Diamonds.

Each pay line that has been wagered upon by the player comprising five cards are then considered to determine if the player is a winner. FIGS. 5–13 illustrate application of pay lines #1–#9 described and illustrated above to the resultant fifteen card set illustrated in FIG. 4.

Figure 5:
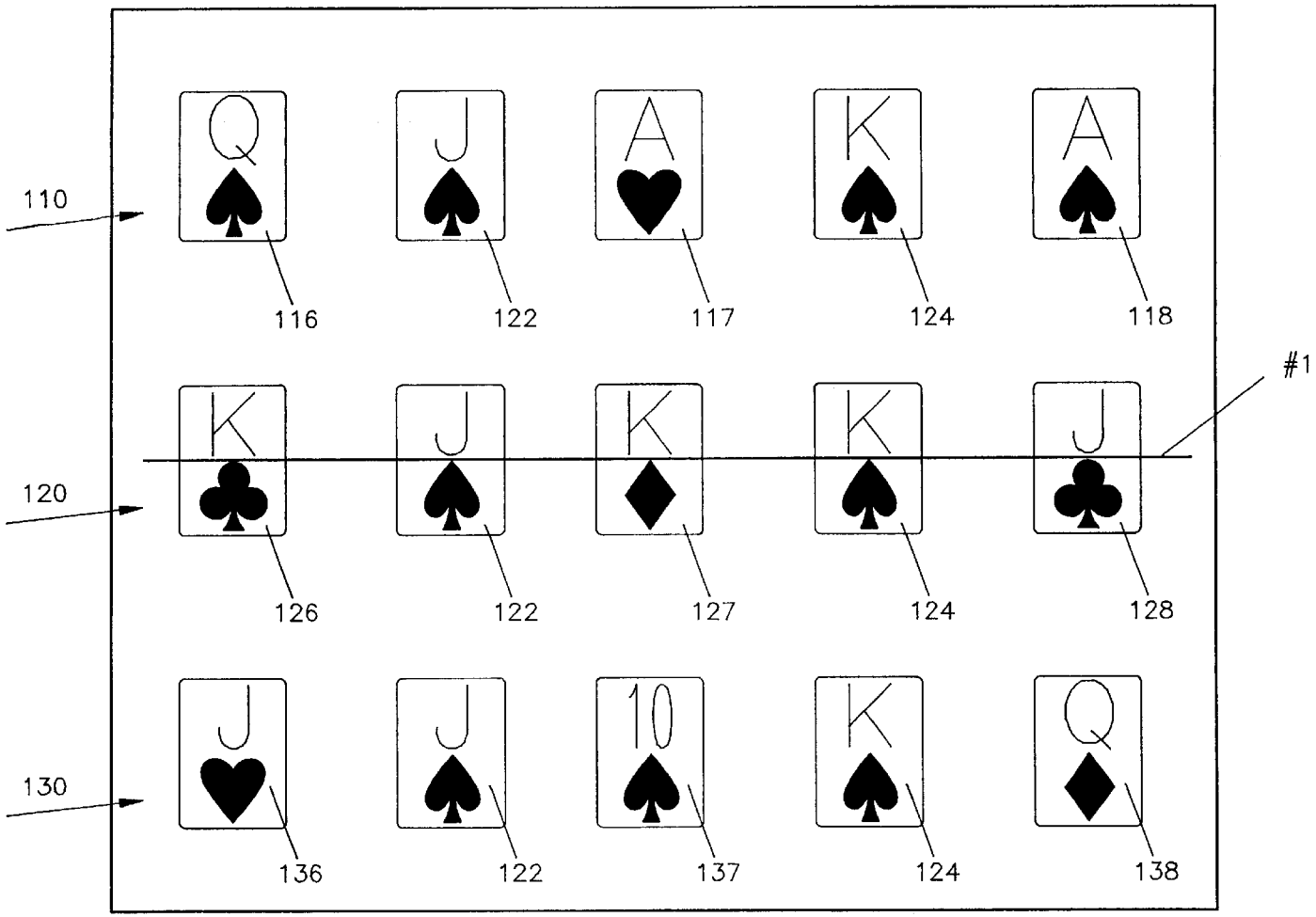
FIG. 5 shows the screen display for the poker game version of the present invention displaying the card positions that correspond to pay line #1.
Figure 6:
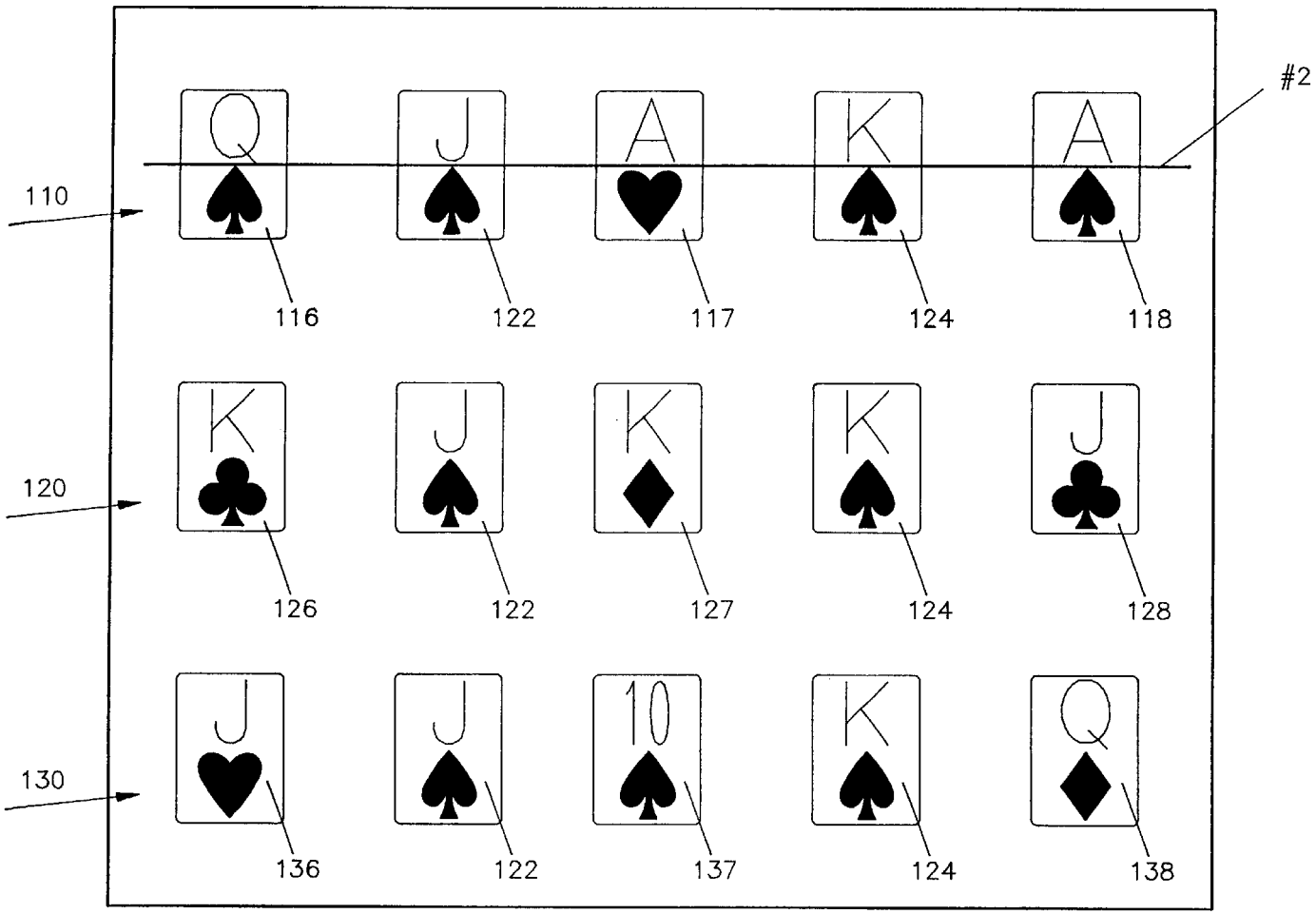
FIG. 6 shows the screen display for the poker game version of the present invention displaying the card positions that correspond to pay line #2.
Figure 7:
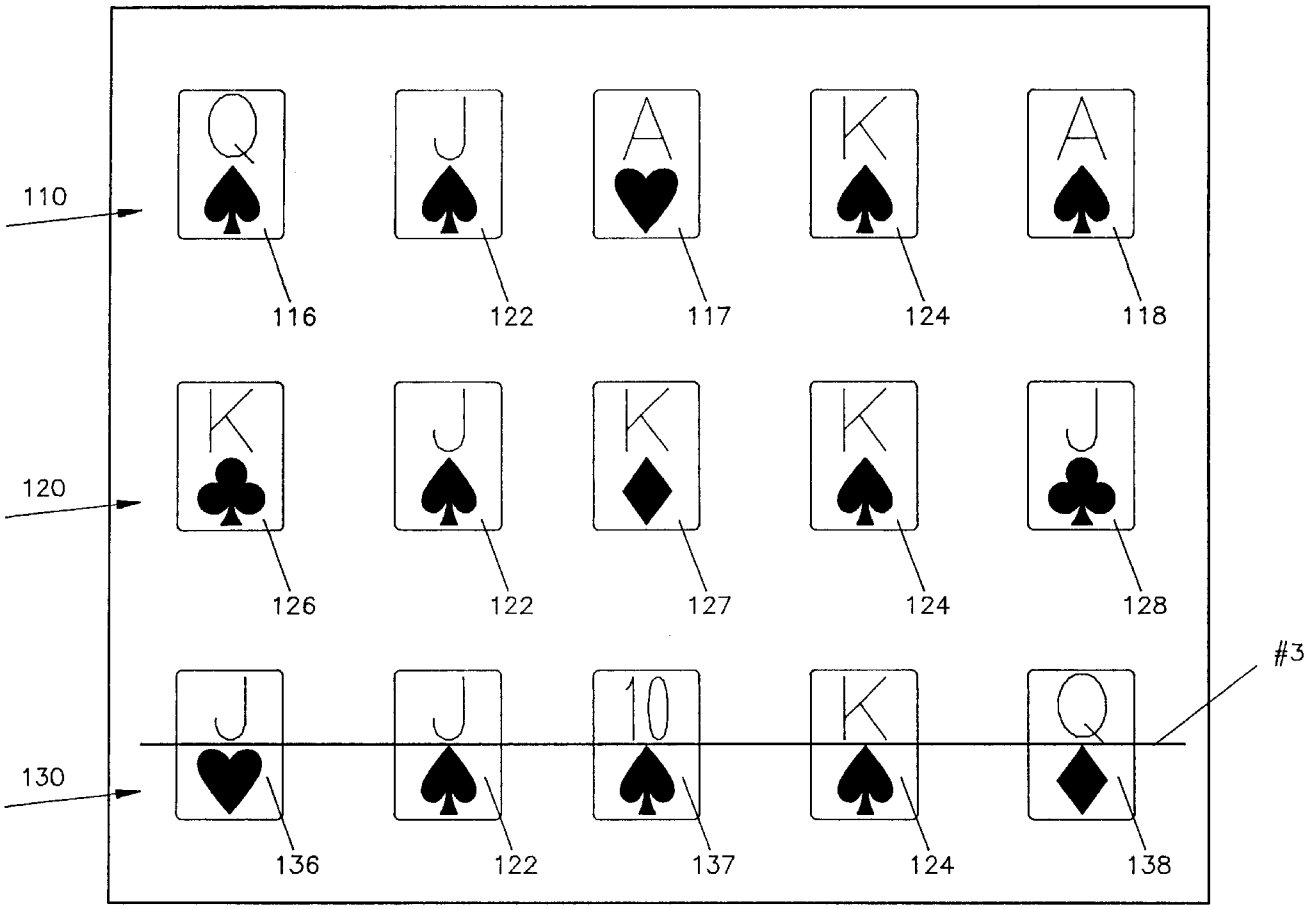
FIG. 7 shows the screen display for the poker game version of the present invention displaying the card positions that correspond to pay line #3.

FIG. 5 illustrates pay line #1 which includes the five cards of the center row 120. As illustrated, after the draw, these five cards have a poker hand ranking of a full house. FIG. 6 illustrates pay line #2 which includes the five cards of the top row 110. As illustrated, after the draw, these cards have a poker hand ranking of a pair of Aces. FIG. 7 illustrates pay line #3 which includes the five cards of the bottom row 130. As illustrated, after the draw, these cards have a poker hand ranking of a pair of Jacks.

Figure 8:
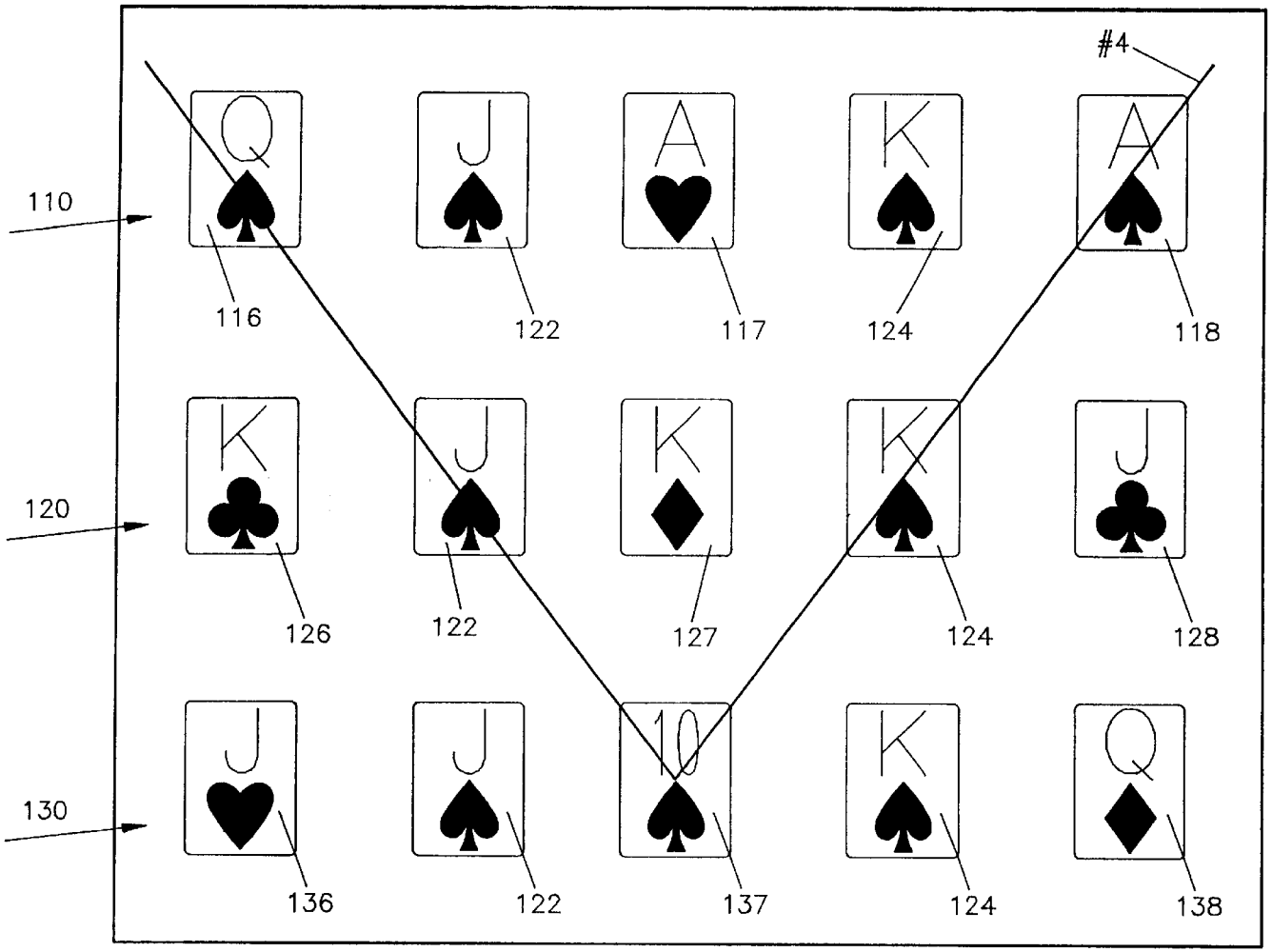
FIG. 8 shows the screen display for the poker game version of the present invention displaying the card positions that correspond to pay line #4.
Figure 9:
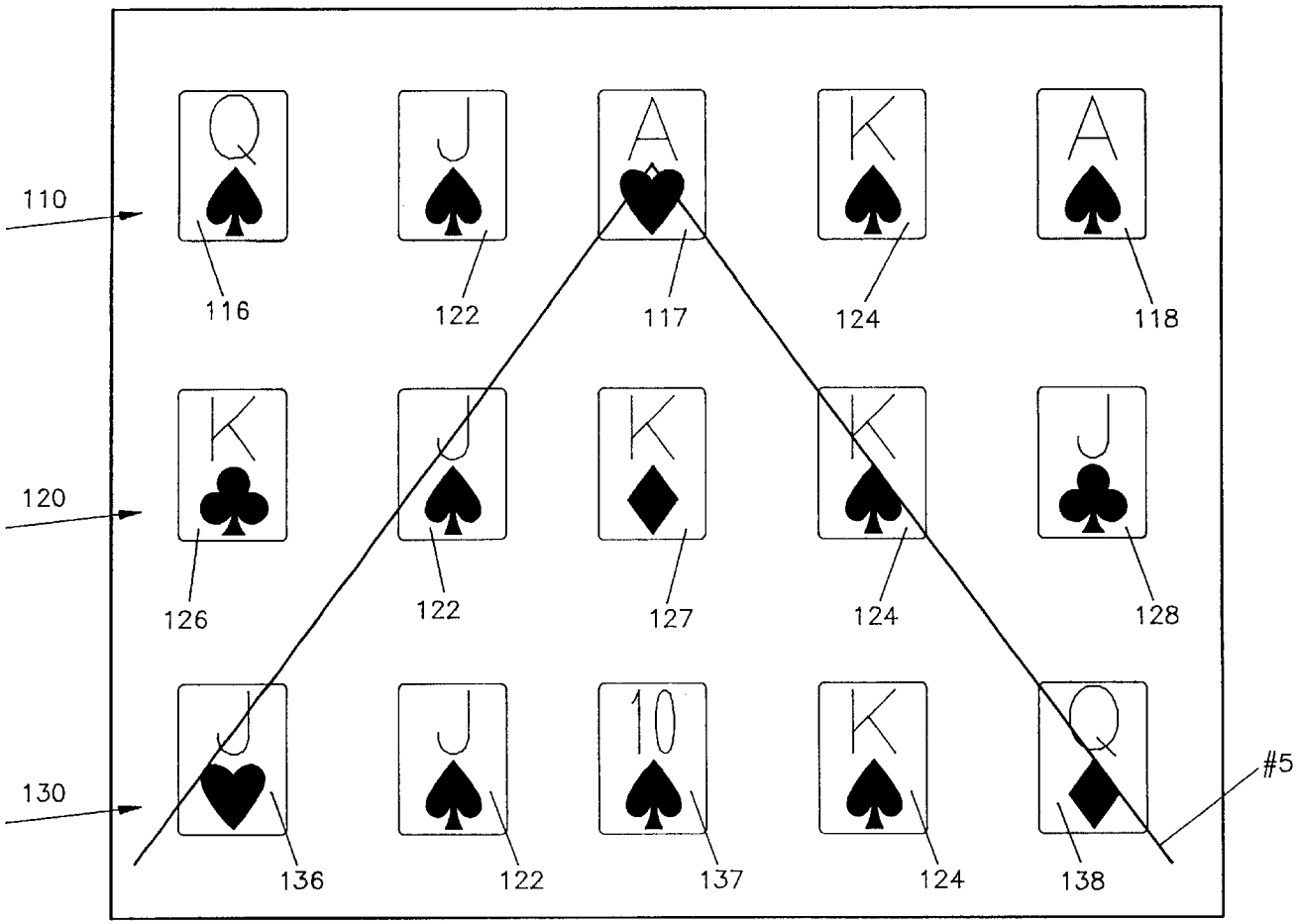
FIG. 9 shows the screen display for the poker game version of the present invention displaying the card positions that correspond to pay line #5.
Figure 10:
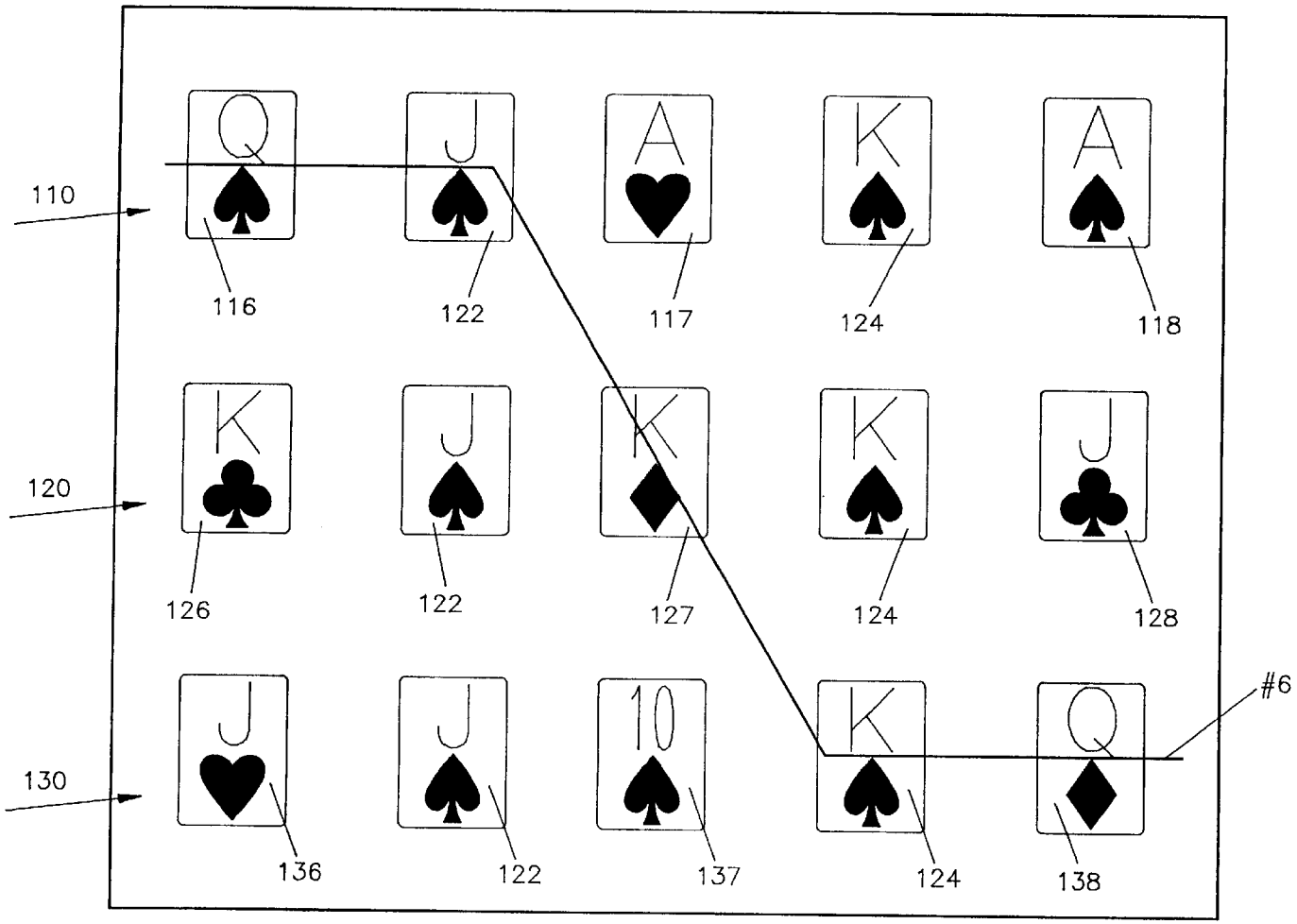
FIG. 10 shows the screen display for the poker game version of the present invention displaying the card positions that correspond to pay line #6.

FIG. 8 illustrates pay line #4 which comprises a "V"-shaped pay line containing cards from each of the rows. After the draw, the cards along this pay line have a poker hand ranking of a Royal Flush. FIG. 9 illustrates pay line #5 which comprises an inverted "V"-shaped pay line containing cards from each of the rows. After the draw, the cards along this pay line have a poker hand ranking of a pair of Jacks. FIG. 10 illustrates pay line #6 which comprises two cards from the top row, a single card from the middle row, and two cards from the bottom row. After the draw, the cards along this pay line have a poker hand ranking of two pair.

Figure 11:
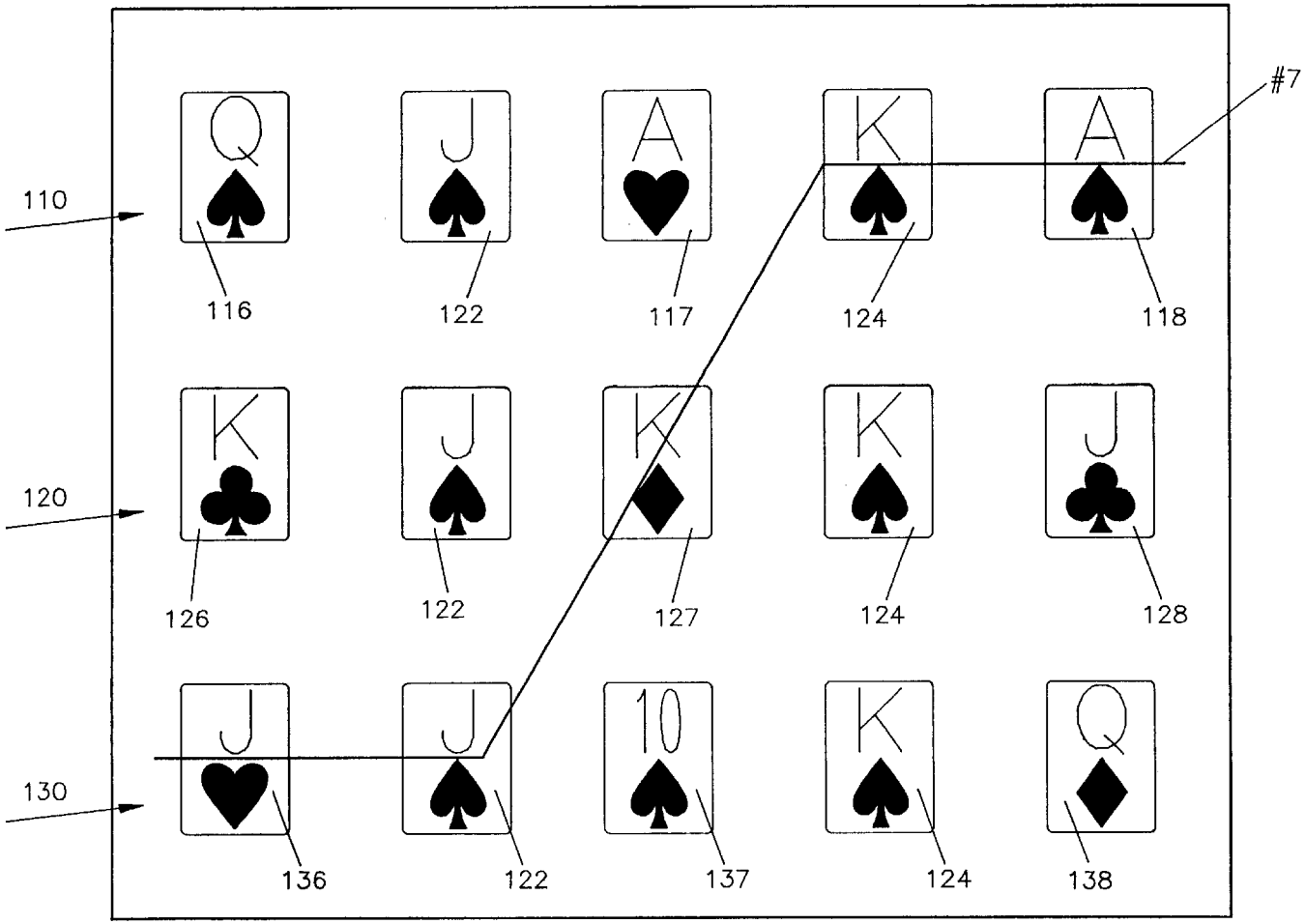
FIG. 11 shows the screen display for the poker game version of the present invention displaying the card positions that correspond to pay line #7.
Figure 12:
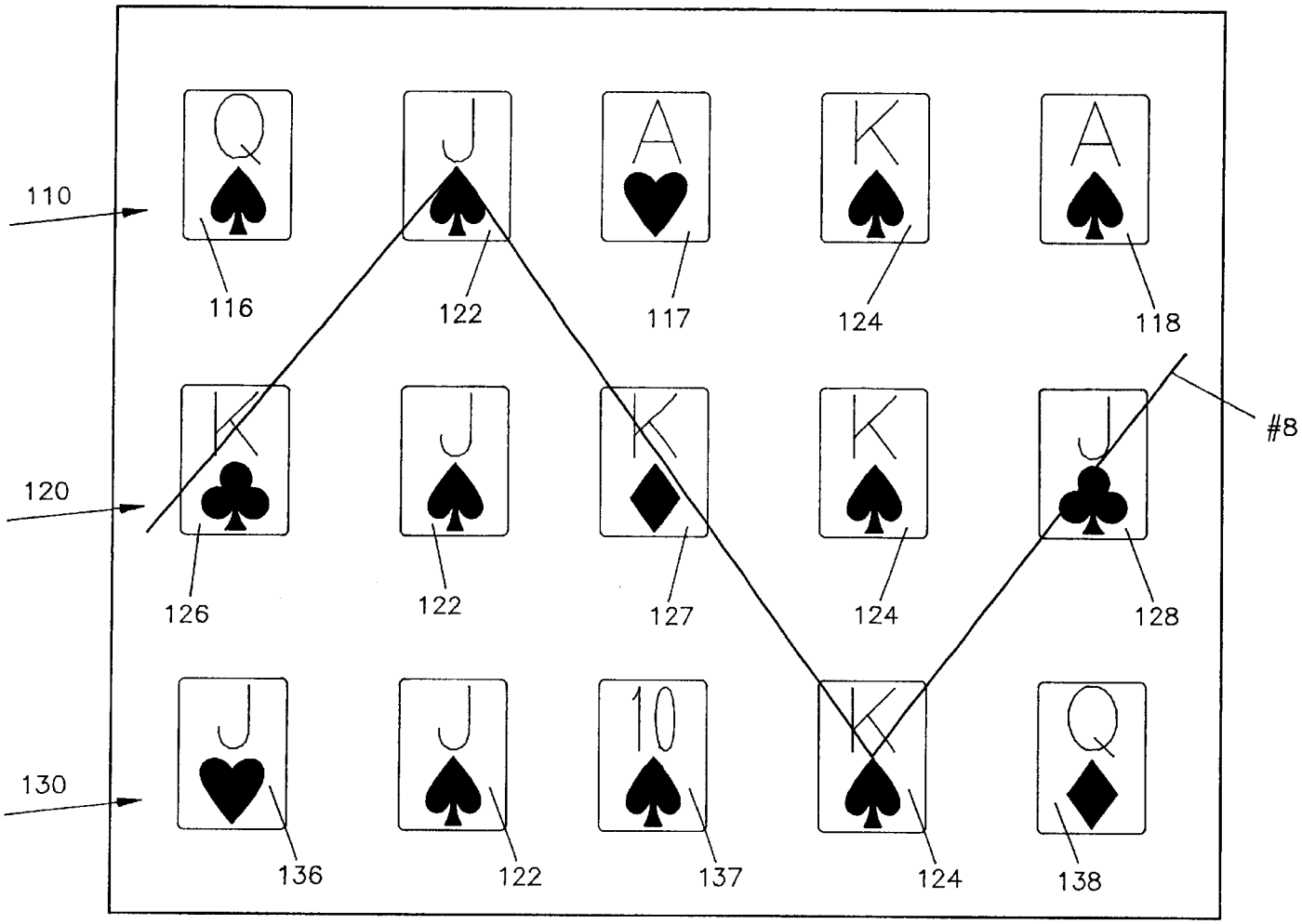
FIG. 12 shows the screen display for the poker game version of the present invention displaying the card positions that correspond to pay line #8.
Figure 13:
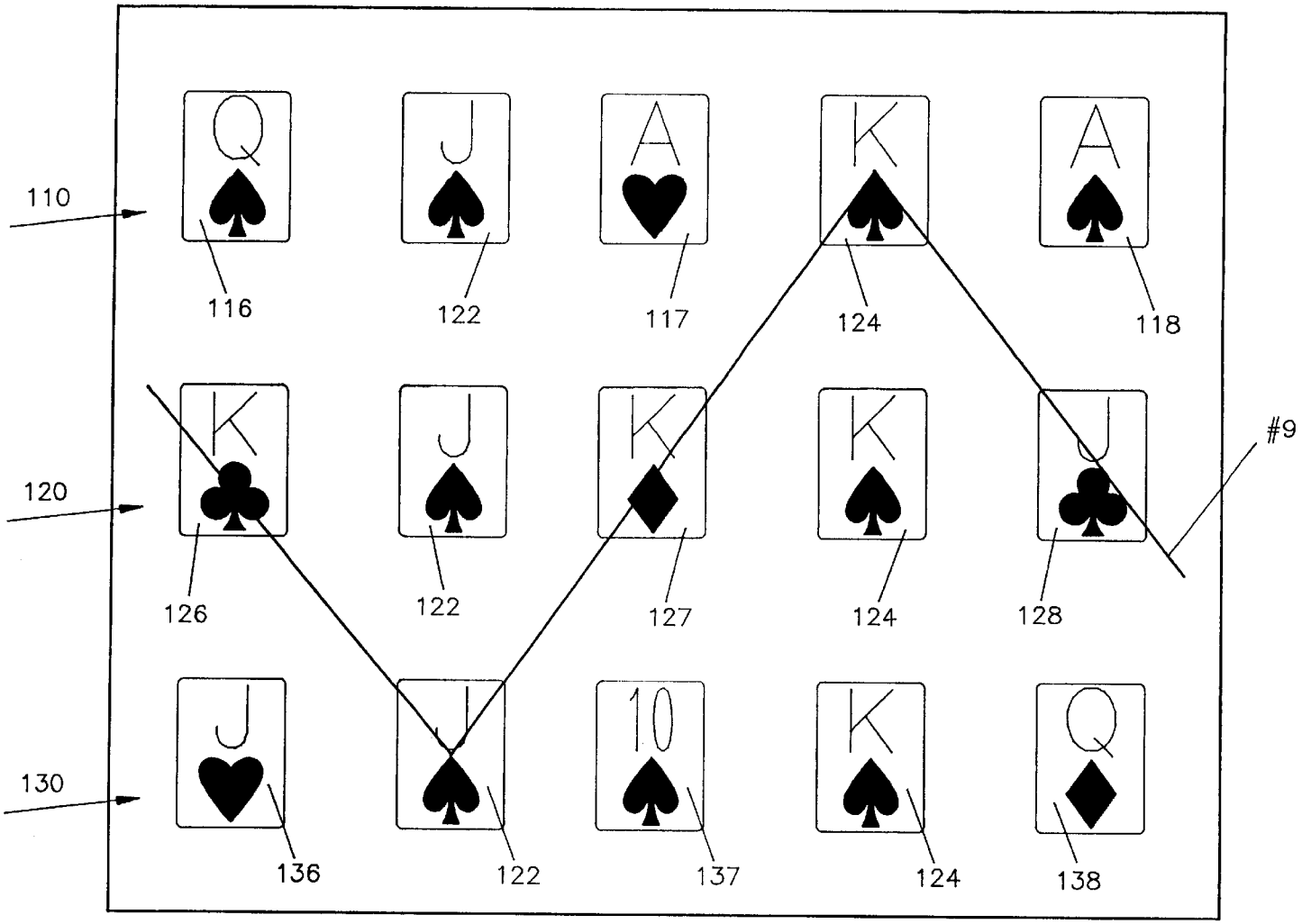
FIG. 13 shows the screen display for the poker game version of the present invention displaying the card positions that correspond to pay line #9.

FIG. 11 illustrates pay line #7 which comprises two cards from the bottom row, a single card from the middle row, and two cards from the top row. After the draw, the cards along this pay line have a poker hand ranking of two pair. FIG. 12 illustrates pay line #8 which comprises three cards from the middle row, and a single card from each of the top row and bottom row. After the draw, the cards along this pay line have a poker hand ranking of a full house. Finally, FIG. 13 illustrates pay line #9 which comprises three cards from the middle row, and a single card from each of the top row and bottom row. After the draw, the cards along this pay line have a poker hand ranking of a full house.

As described above, the cards along each pay line for which the player has placed a wager are evaluated for poker hand ranking and the player is paid based on the amount of his wager for that pay line.

Any suitable pay table can be used to determine the payouts associated with the various poker hand rankings that may be achieved by the player. The particular pay table that is used is based on the mathematical return desired to be provided on the gaming machine.

The arrangement of multiple pay lines may be applied to versions of the game having more or less than three rows of cards, such as two, four, five or more rows of cards. It is also possible to apply the principles of this invention to poker hands that have less than five cards, such as three-card poker or four-card poker by providing each row with only three cards or four cards. Furthermore, each row could have six or more cards if desired.

Electronic Slot Games

Another version of the present invention comprises a method of play that can be programmed on an electronic video slot machine. Each electronic video slot machine is programmed to display multiple pay lines with each pay line displaying multiple symbols. Each pay line with its multiple symbols are displayed on a video screen to a player. In essence, this game has many of the characteristics of the above-described poker game, except that the symbols may comprise types of indicia other than cards.

Initially, the player selects the number of pay lines that the player wishes to play and the player selects the amount the player wishes to wager on each pay line. Then, a row of symbols are first randomly selected and displayed on a first row, such as the center row. By manipulating the buttons on the gaming device or by using conventional touch screen technology, the player selects which of the initial symbols on the fist row the player wishes to hold and which symbols he wishes to discard. Symbols that are held by the player are then duplicated or reused into all of the other rows that are displayed.

Replacement symbols are then randomly selected and displayed for the discarded symbols and the outcome of the play of the game is determined. Each pay line that has been wagered upon by the player is analyzed to determine if a winning combination of slot symbols appears on that pay line. Any suitable arrangement of pay lines may be used, such as the nine pay lines that are used in the poker game version of the present invention.

In the preferred embodiment of the present invention, the player is required to make a wager on the first pay line and at least one of the other pay lines. Generally, the pay lines wagered on by the player would be activated in order from pay line #1 through pay line #9, but any other order of activation could be used.

In the preferred embodiment of this version of the present invention, the amount of the player's wager on each pay line would be the same. Alternatively, the player could be allowed to make wagers of different amounts on each pay line.

The number of symbols used in the method of play is not critical and is based on the probabilities desired to be employed in the game.

Any suitable pay table can be used with the winning amounts and symbol combinations being based on the mathematical return desired to be provided on the gaming machine.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game in which a plurality of paylines are used and a wager is made to activate each pay line comprising:

a) displaying a first row of five cards;

b) selecting none, one or more of the cards from the first row of cards as cards to be held;

c) reusing the cards selected to be held from the first row of cards in a second row of cards;

d) reusing the cards selected to be held from the first row of cards in a third row of cards;

e) discarding from the first row of cards the unselected cards and replacing each of the unselected cards with a replacement card;

f) providing additional cards to the second row of cards so that the second row of cards has five cards;

g) providing additional cards to the third row of cards so that the third row of cards has five cards;

h) each pay line comprising a grouping of five cards from one or more of the first row of cards, the second row of cards and the third rows of cards; and i) determining the poker hand ranking of the resulting cards of each pay line.

2. The method of claim 1 wherein one of the pay lines comprises the five cards in the first row of cards.

3. The method of claim 1 wherein one of the pay lines comprises the five cards in the second row of cards.

4. The method of claim 1 wherein one of the pay lines comprises the five cards in the third row of cards.

5. The method of claim 1 wherein one of the pay lines comprises two cards from the first row of cards, two cards from the second row of cards and one card from the third row of cards.

6. The method of claim 1 wherein one of the pay lines comprises two cards from the first row of cards, one card from the second row of cards and two cards from the third row of cards.

7. The method of claim 1 wherein one of the pay lines comprises one card from the first row of cards, two cards from the second row of cards and two cards from the third row of cards.

8. The method of claim 1 wherein the number of paylines selected exceeds the number of rows of the cards.

9. The method of claim 1 including paying the player an award based on the poker hand ranking of the pay line and the amount of the player's wager on that pay line according to a pay table.

10. The method of claim 1 including the step of a player placing a single wager for each pay line to be played.

11. The method of claim 1 including the step of a player placing a wager to play multiple pay lines.

12. The method of claim 1 wherein the replacement cards and additional cards provided in accordance with steps e), f) and g) are provided from a single deck of cards.

13. The method of claim 1 wherein the replacement cards in accordance with step e) are provided from a first deck of cards, the additional cards provided in accordance with step f) are provided from a second deck of cards, and the additional cards provided in accordance with step g) are provided from a third deck of cards.

14. A method of playing a card game in which a plurality of paylines are used and a wager is made to activate each pay line comprising:

a) providing a fifteen card display having a first row, a second row and a third row with each row having five card locations;

b) displaying cards at each of the five card locations in the first row;

c) selecting none, one or more of the cards from the first row as cards to be held;

d) reusing the cards selected to be held from the first row in card locations in the second row;

e) reusing the cards selected to be held from the first row in card locations in the third row;

f) discarding from the first row the unselected cards and replacing each of the unselected cards with a replacement card;

g) providing additional cards to the second row so that the second row has five cards;

h) providing additional cards to the third row so that the third row has five cards;

i) selecting one or more hands comprising five cards from the fifteen card locations, each pay line comprising one of the hands of five cards selected from the fifteen card locations; and j) determining the poker hand ranking of the resulting cards of each pay line.

15. The method of claim 14 wherein one of the pay lines comprises the hand of five cards comprising the first row of cards.

16. The method of claim 14 wherein one of the pay lines comprises the hand of five cards comprising the second row of cards.

17. The method of claim 14 wherein one of the pay lines comprises the hand of five cards comprising the third row of cards.

18. The method of claim 14 wherein one of the pay lines comprises a hand comprising two cards from the first row of cards, two cards from the second row of cards and one card from the third row of cards.

19. The method of claim 14 wherein one of the pay lines comprises a hand comprising two cards from the first row of cards, one card from the second row of cards and two cards from the third row of cards.

20. The method of claim 14 wherein one of the pay lines comprises a hand comprising one card from the first row of cards, two cards from the second row of cards and two cards from the third row of cards.

21. The method of claim 14 wherein the number of paylines selected exceeds the number of rows of the cards.

22. The method of claim 14 including paying the player an award based on the poker hand ranking of the hand of each pay line and the amount of the player's wager on that pay line according to a pay table.

23. The method of claim 14 including the step of a player placing a single wager for each pay line to be played.

24. The method of claim 14 including the step of a player placing a wager to play multiple pay lines.

25. The method of claim 14 wherein the replacement cards and additional cards provided in accordance with steps f), g) and h) are provided from a single deck of cards.

26. The method of claim 14 wherein the replacement cards in accordance with step f) are provided from a first deck of cards, the additional cards provided in accordance with step g) are provided from a second deck of cards, and the additional cards provided in accordance with step h) are provided from a third deck of cards.

27. A method of playing a game in which a plurality of paylines are used and a wager is made to activate each pay line comprising:

a) displaying a first row of symbols;

b) selecting none, one or more of the symbols from the first row of symbols as symbols to be held;

c) reusing the symbols selected to be held from the first row of symbols in a second row of symbols;

d) reusing the symbols selected to be held from the first row of symbols in a third row of symbols;

e) discarding from the first row of symbols the unselected symbols and replacing each of the unselected symbols with a replacement symbol;

f) providing additional symbols to the second row of symbols so that the second row of symbols has the same number of symbols as the first row;

g) providing additional symbols to the third row of symbols so that the third row of symbols has the same number of symbols as the first row;

h) each pay line comprising a grouping of symbols from one or more of the first row of symbols, the second row of symbols and the third rows of symbols; and i) determining the symbol ranking of the resulting symbols of each pay line.

28. The method of claim 27 wherein one of the pay lines comprises the symbols of the first row of symbols.

29. The method of claim 27 wherein one of the pay lines comprises the symbols of the second row of symbols.

30. The method of claim 27 wherein one of the pay lines comprises the symbols of the third row of symbols.

31. The method of claim 27 wherein each of the first row, second row and third row has five symbols.

32. The method of claim 27 wherein one of the pay lines comprises two symbols from the first row of symbols, two symbols from the second row of symbols and one symbols from the third row of symbols.

33. The method of claim 27 wherein one of the pay lines comprises two symbols from the first row of symbols, one symbol from the second row of symbols and two symbols from the third row of symbols.

34. The method of claim 27 wherein one of the pay lines comprises one symbol from the first row of symbols, two symbols from the second row of symbols and two symbols from the third row of symbols.

35. The method of claim 27 wherein the number of paylines activated exceeds the number of rows of the symbols.

36. The method of claim 27 including paying the player an award based on the ranking of the group of symbols of the pay line and the amount of the player's wager on that pay line according to a pay table.

37. The method of claim 27 including the step of a player placing a single wager for each pay line to be played.

38. The method of claim 27 including the step of a player placing a wager to play multiple pay lines.

* * * * *